United States Patent [19]

Valavaara

[11] Patent Number: 5,059,101

[45] Date of Patent: Oct. 22, 1991

[54] FLUID END

[76] Inventor: Viljo K. Valavaara, 2797 Battleford Road, Mississauga, Ontario, Canada, L5N 2W2

[21] Appl. No.: 424,912

[22] Filed: Oct. 23, 1989

Related U.S. Application Data

[63] Continuation-in-part of Ser. No. 299,467, Jan. 23, 1989, abandoned.

[51] Int. Cl.[5] ..... F04B 21/00

[52] U.S. Cl. ..... 417/569; 417/560; 417/539

[58] Field of Search ..... 417/569, 560, 539; 92/165 R

[56] References Cited

U.S. PATENT DOCUMENTS 2,081,221 5/1937 Coberly et al. ..... 417/539

2,092,641 9/1937 Doran ..... 417/539

3,476,014 11/1969 Churchill, Jr. et al. ..... 92/255

*Primary Examiner*—Leonard E. Smith

*Assistant Examiner*—David W. Scheuermann

[57] ABSTRACT

A fluid end assembly for a plunger pump of the type having a power end to which fluid end assemblies are attached, the fluid end assembly having a plurality of cylinders, a valve housing attachable to one end of the cylinders, clamps for clamping the cylinders, fastening devices passing through the valve housing, and engaging the clamps, and the fastening devices being secured in the power end, and abutments formed on the fastening devices between the clamps and the power end, to confine the load developed in the valve housing, between the valve housing and the cylinders and thereby reduce the load on that portion of the fastening devices secured in the power end.

8 Claims, 4 Drawing Sheets

FLUID END

This application is a Continuation-in-Part of application Ser. No. 07/299,467 filed on Jan. 23, 1989, abandoned on Nov. 13, 1989 entitled PUMP FLUID END.

FIELD OF THE INVENTION

The invention relates to plunger pumps of the type that are used for producing high pressure fluid jets, and in particular, to the fluid ends of such plunger pumps.

BACKGROUND OF THE INVENTION

Plunger pumps consist of a so-called "power end" and a "fluid end". Typically the power end consists of a crank shaft, and a plurality of connecting rods, coupled to pistons which, in turn, are carried in guide sleeves or cylinders. To this extent such power ends resemble the design of a typical automotive engine.

The fluid end assemblies are attached to the power end, in the place where the cylinder head would normally be found in an automotive engine. Typically such fluid ends consist of a cylinder or pressure chamber having suitable inlet and outlet ports with valves, and a plunger adapted to reciprocate in the cylinder. The plungers are coupled to the pistons in the power end.

Pumps of this general type are available from a variety of different manufacturers. It will, of course, be appreciated that such pumps are multi-cylinder pumps, and there will be one fluid end for each cylinder. In many cases, the fluid ends are manufactured as a single assembly, or are mounted on a common mounting plate, which is then attached directly to the cylinder block of the power end. In most cases, the power ends are manufactured by one manufacturer, and the fluid ends are manufactured by another, and are then assembled together. Certain manufacturing tolerances are permitted in the manufacturing of the power ends, and also the fluid ends. Where these tolerances do not precisely match, then it may cause difficulties in matching or mounting the fluid end assembly to the power end assembly. This is not simply a matter of allowing for tolerances in the location of fastening holes and the like. This itself would present little or no problem. The problem is that the plungers of the fluid ends are mounted on the pistons in the power ends. If the centres of the pistons do not precisely match the centres of the fluid end cylinders, then the plungers will be slightly offset from the axis of the fluid end cylinder.

This will then cause a high degree of wear, leading to failure of fluid seals and breakdown of the pump.

Another separate problem in the design of such fluid ends, lies in the manner in which they are bolted to the cylinder block of the power end. During the pumping action of the plungers, very substantial hydraulic forces are developed in the fluid end cylinders. In past designs, a system of bolts was provided clamping the entire fluid end cylinder assembly directly on to the power end cylinder block. As a result, all of the stresses created by the hydraulic forces developed in the fluid end cylinders were carried directly through these hold-down bolts, to threads formed in the cylinder block of the power end. The engineering of these hold-down bolts and the threads in the block had to be sufficient to withstand these stresses.

This problem of stresses generated in the fluid end is more complex than it appears. During the power stroke, the force developed by the plunger is calculated by multiplying the maximum pounds per square inch of hydraulic pressure by the area of the piston head. This force is clearly transmitted back to the cylinder block of the power end, and the cylinder block of the power end must be engineered so as to withstand it. In practice this type of engineering is well understood and is generally speaking managed in a satisfactory manner.

However, the fluid end consists of two components mainly the cylinder itself, and the valve housing attached to the top of the cylinder. Fluid seals, typically O-rings, are located between the valve housing and the cylinder. These O-rings must necessarily be located in grooves which are spaced radially outwardly from the cylinder. The force that is developed on the valve housing will, therefore, be calculated by multiplying the maximum pounds per square inch of hydraulic pressure by the area of the valve housing contained within the O-rings seal. Even though the O-ring seal is only slightly spaced radially outwardly with respect to the cylinder, this area may easily be fifty to one hundred percent greater than the area of the piston head.

Consequently, the force applied to the valve housing may be double that applied to the piston head. In the usual design of hold-down bolts, this means that the hold-down bolts, and their receiving threads in the cylinder block of the power end, must be engineered so as to withstand twice the force imposed on the piston head. This greatly increases the difficulty of engineering a satisfactory power end, and a satisfactory system of hold-down bolts, and in fact, is a frequent cause of problems in such plunger pumps.

Another problem in relation to plunger pumps lies in the servicing of the fluid ends. In use, it is necessary to strip down and service the fluid end from time to time, to replace fluid seals, and other worn parts. If, for example, when a pump is in use on a job site, one of its fluid ends develops a problem, it was generally necessary to remove the entire fluid end assembly for servicing. This caused considerable downtime, and possible entry of contaminants into fluid end cylinders which were otherwise sound.

BRIEF SUMMARY OF THE INVENTION

With a view to overcoming these various problems, the invention comprises a fluid end assembly for use in a plunger pump apparatus of the type having a power end, to which said fluid end assembly is attached, said power end having a plurality of threaded holes for receiving fastening means, said fluid end assembly comprising cylinder means, a valve housing block adapted to be attached at one end of said cylinder means, clamping means for securing said cylinder means, and a plurality of fastening devices, in turn, comprising rod means, securement means at each end of said rod means, being adapted to be secured to said power end block, and, abutment means formed on said rod means intermediate said ends, said abutment means being located so as to engage said clamping means, and means at the other ends of said rod means, whereby to engage said valve housing block, thereby confining hydraulic stresses developed in said valve housing block and avoid transmitting said hydraulic stresses to said power end.

More particularly, it is an objective of the invention to provide a fluid end assembly having the foregoing advantages wherein said rod means defines a power end portion, of a predetermined first diameter, and a fluid end portion of a predetermined second diameter greater than said first diameter, and wherein said abutment means comprises collar means formed on said rod means between said power end portion and said fluid end portion.

More particularly, it is an objective of the invention to provide a fluid end assembly having the foregoing advantages wherein said cylinder means includes collar means defining an opening of reduced diameter in relation to the diameter of said cylinder means, packing means within said cylinder means, and, plunger means adapted to pass through said opening in said collar means, and through said packing means in said cylinder means, said plunger means being coupled to said power end, for reciprocation within said cylinder means.

In accordance with one form of the invention, the clamping means may comprise clamping flanges formed integrally with individual cylinder, and said clamping flanges defining notches, for reception of said rod means. In another embodiment of the invention, the clamping means may comprise a clamping plate means, formed separately from the cylinders, and having openings through which said rod means pass, thereby clamping the cylinders to the valve housing block.

In accordance with a further feature of the invention, each of the cylinders is separate from one another, and tolerances are provided, both on the cylinders, and in the clamping means, and in the valve housings, whereby the cylinders are essentially "floating" so as to centre on their respective pistons.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
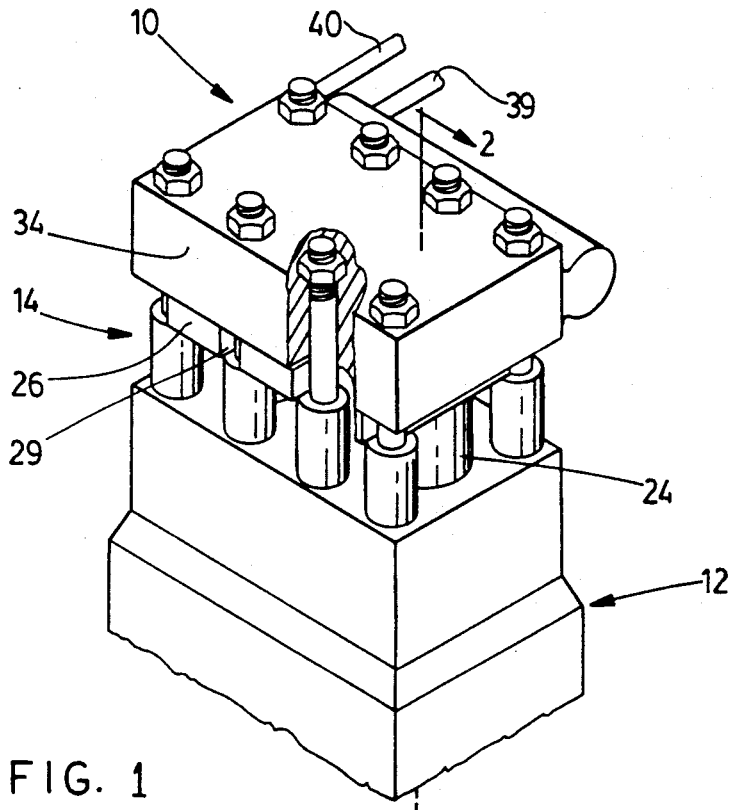
FIG. 1 is a perspective illustration of a plunger pump apparatus in accordance with the invention partially cut away.
Figure 3:
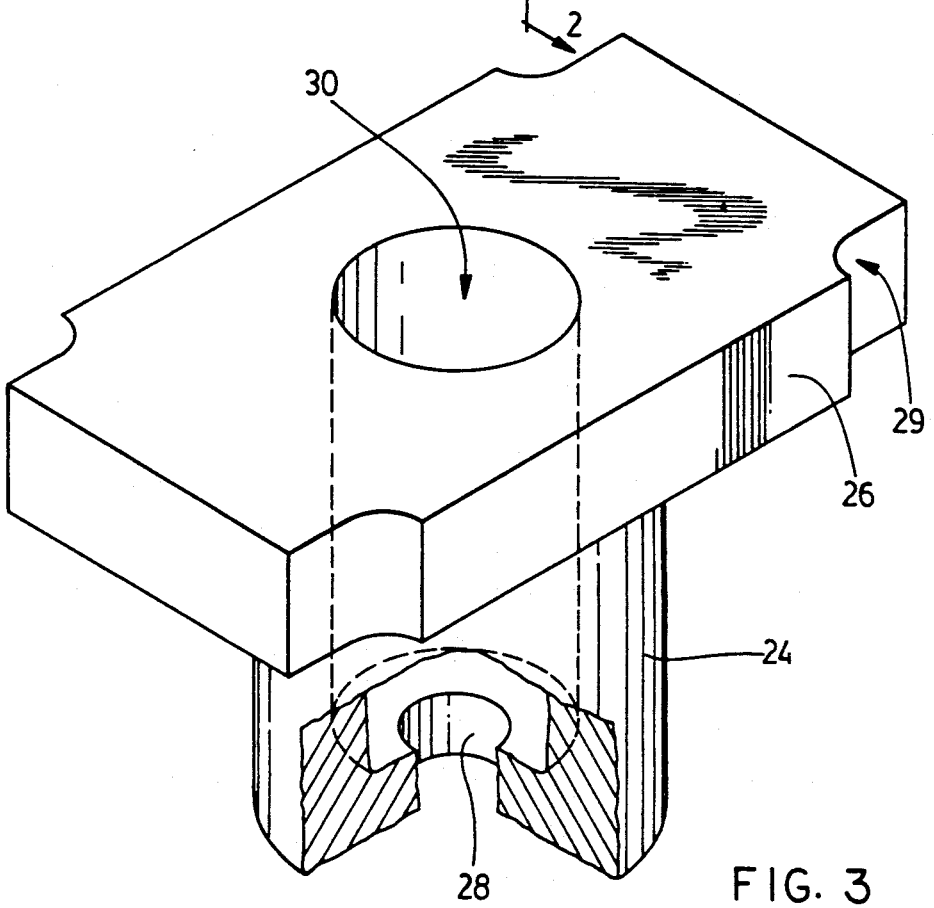
FIG. 3 is a perspective illustration of a fluid end cylinder shown in isolation.

Referring first of all to FIG. 1, the invention is there illustrated in an embodiment of a plunger pump indicated generally as 10. The pump 10 comprises, in general, a power end portion 12, and a fluid end portion indicated generally as 14.

The plunger pump illustrated comprises three cylinders, although it will be appreciated that a smaller or greater number of cylinders could be used in some cases.

Figure 2:
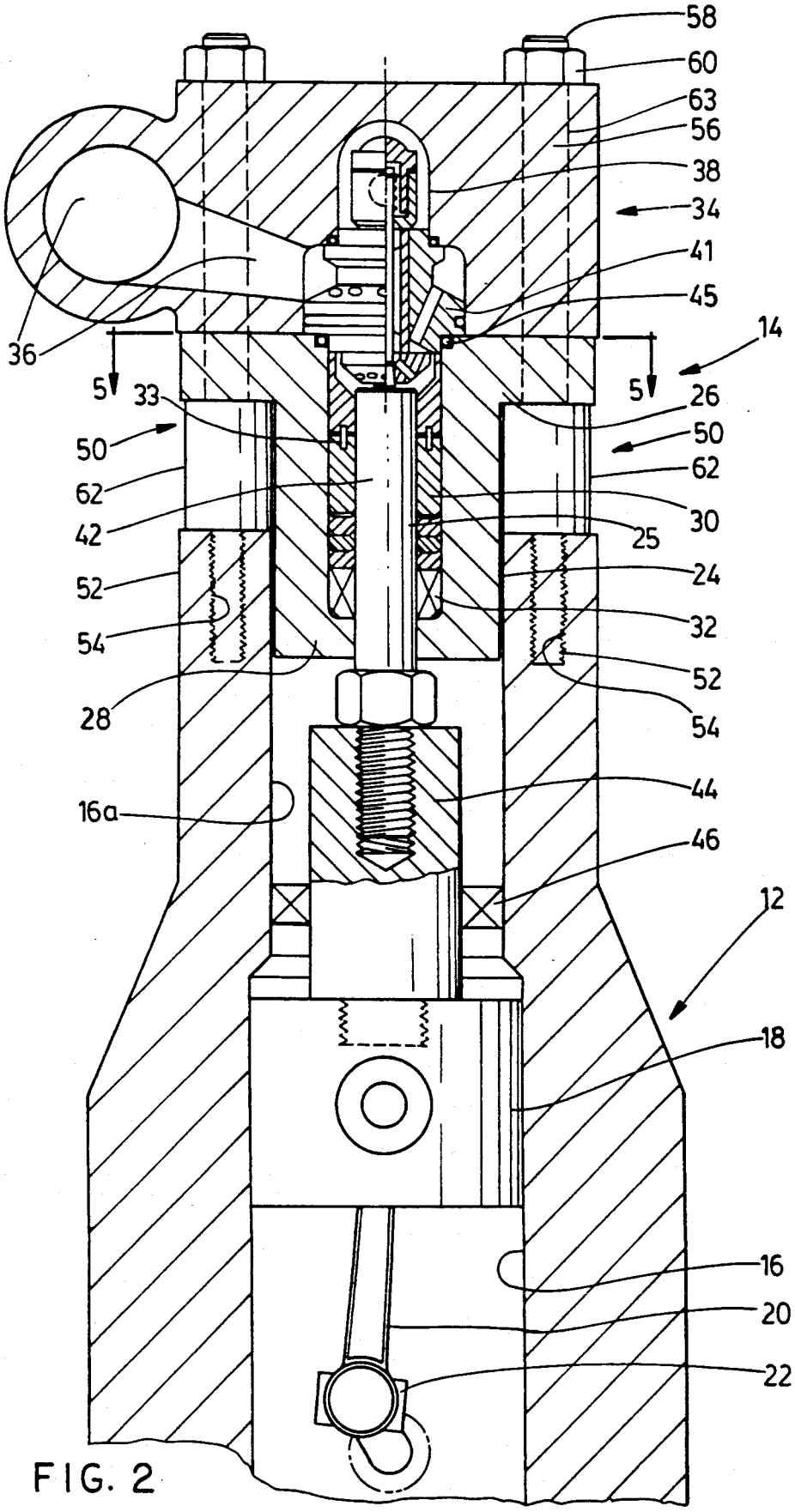
FIG. 2 is a section along the line 2—2 of FIG. 1.

Referring now to FIG. 2, the power end portion of the pump 10 will be seen to be comprised of a plurality of cylinders 16, receiving pistons 18. Pistons 18 are connected by connecting rods 20 to crank shaft 22. In fact, three such pistons 18 are provided, being connected to the crank shaft 22 on cranks which are offset 120 degrees from one another in a manner well known in the art.

To this extent, the power end portion somewhat resembles the design of an automobile engine, although performing substantially different functions.

The fluid end portion 14 comprises three separate pressure cylinders 24 defining interior chambers 25 and, having upper clamping flanges 26, and lower collar portions 28. Flanges 26 have notches 29 at all four corners.

Within cylinders 24, packing means 30 are provided to reduce the diameter of the cylinder, and sealing means 32 are provided adjacent to the collar 28. An elastomeric spring 33 is incorporated in the packing means 30, whereby to preload the same in compression, whereby to prevent the packing from moving in the cylinder, due to friction with the piston or plunger.

It will be understood that the three cylinders 24 are separate from one another, and when assembled together in the completed pump as shown in FIG. 1, they are located side by side with one another, and in this embodiment, with a portion of each cylinder 24 entering its respective upper portion **16*a* of the cylinder 16 of the power end 12**.

In order to permit the cylinders to adopt their own centres, a tolerance or spacing is provided between the sides of the clamping flanges 26 of adjacent cylinders 24, and tolerances are provided between the outside diameter of each cylinder 24, and the interior diameter of the cylinder portion **16*a* of the power end 12**.

These tolerances are necessary in order to accommodate the tolerances in the power end 12. Typically these tolerances will be in the order of plus or minus 0.003 of an inch. Thus, when the fastening devices 50 are secured to the power end, the tolerances of the notches 29 on the clamping flanges 26, and the tolerances of the holes 63 in the valve housing 34 must be such that they can accommodate this degree of variation.

In this way, each of the cylinders 24 can centre itself on its respective plunger 42. This overcomes problems with conventional pumps in which rapid wear is caused by misalignment of the plungers in their respective cylinders.

The clamping flange portions 26 of the cylinders 24 are clamped to a valve housing block 34 in a manner described below. Valve housing block 34, in turn, is provided with longitudinal supply and return conduits 36 and 38, for supplying a fluid, and for receiving the high pressure fluid, which are in turn connected to supply and return hoses 39, 40 (FIG. 1).

Supply and return valves 41 are received within block 34, which valves may be of a design known per se and, in any event, form no part of the present invention. Their function is to supply a working fluid to the cylinders 24, and to receive the fluid therefrom. Such valves 41 are shown in more detail in FIG. 6.

It will be noted that while the cylinders 24, in this embodiment, define three separate structures, the valve housing block 34 defines a unitary structure.

Fitting within the packing 30 of cylinders 24, there are provided pistons or plungers 42, adapted to reciprocate within the packing 30.

Each plunger 42 is, in turn, connected to a mounting shaft 44 which is, in turn, connected to a respective piston 18. It will be noted that plunger 42, shaft 44 and piston 18 all define a common central axis. Typically some form of bushing or seal 46 will be provided, to seal shaft 44.

In order to seal between the flanges 26 of the cylinders 24, and the valve housing block 34, any suitable seals such as O-rings 45 are provided. It will be noted that O-rings 45 are located radially outwardly from the plungers 42, and this is the cause of significant problems, as will be apparent from the following explanation.

Figure 4:
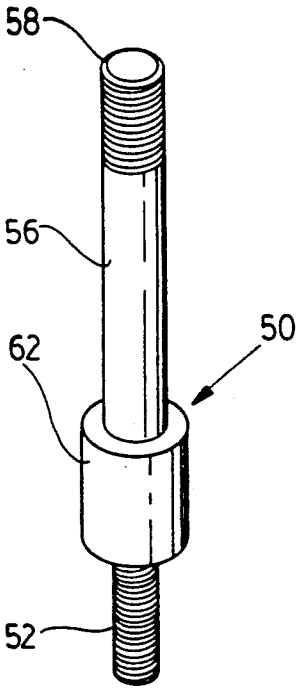
FIG. 4 is a perspective illustration of a fastening device.
Figure 5:
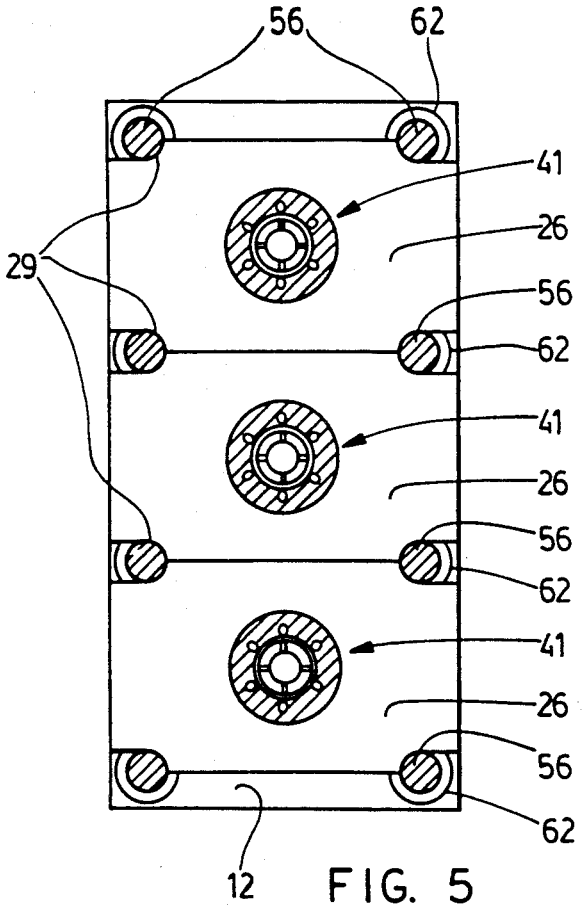
FIG. 5 is a sectional view along line 5—5 of FIG. 2.

In order to secure the valve housing block 34 to the three separate fluid end cylinders 24, and furthermore in order to secure the entire assembly of the valve block housing and the three fluid end cylinders to the power end 12, a plurality, in this case, eight fastening devices or studs indicated generally as 50 are provided (FIG. 4).

Each of the fastening devices 50 will be seen to comprise a lower or power end bolt portion 52, which is threaded, so as to be received in suitable threaded recesses 54 in the power end 12. Each of the fastening devices 50 further comprises a fluid end rod portion 56, threaded as at 58 to receive nuts 60.

Intermediate the portions 52 and 56, there is provided an enlarged abutment portion 62, in this embodiment being of generally cylindrical shape.

Cylinders 24 have an exterior diameter adapted to be received in the upper ends 16 a of the cylinders 16 of power end 12. Abutment portions 62 have a length dimension such that when the power end rod portions 52 are securely seated in their threaded recesses 54, the lower ends of the abutment portions 62 abut against the upper surface of the power end 12.

The upper surfaces of the abutment portions 62 will abut against the underside surfaces of the clamping flanges 26 of the cylinders 24. Thus, the abutment portions 62 limit the extent to which the cylinders 24 can enter the upper ends 16*a* of cylinders 16 of the power end 12. The fluid end rod portions 56 fit loosely in the notches 29 of flanges 26 and pass through oversize holes 63 in valve housing 34.

The abutment portions 62 clamp the flanges 26 to the valve housing 34 and thus provide a further highly significant function, in that they reduce the load on the power end rod portion 52, and the threaded recess 54, in power end 12. In addition, rod portion 52 is of a predetermined first, diameter, and rod portion 56 is of a greater diameter than the predetermined first diameter, so that rod portion 56 is adapted to resist the hydraulic stresses.

These two features solve certain problems peculiar to such fluid ends. As the plunger enters into its cylinder, it displaces the fluid within the cylinder, through the valve 41, and creates a substantial hydraulic pressure in doing so. This pressure is effectively "seen" over a major portion of the surface area of the valve block 34, i.e. that area of the valve block housing contained within the diameter of the seal 25. It will be appreciated that this area is at least double if not more the area of the head of the plunger 42. As a result, the force (pressure x surface area) applied to the valve block 34 is very substantially greater than the force applied to the head of the plunger 42.

The power end 12 and its threaded recesses 54 are designed, in most cases, to withstand the forces generated by the rotation of the crank shaft 22 and the reciprocation of the cylinders 18. However, these forces are multiplied considerably by the effect of the hydraulic pressure generated within the cylinders 24, which is then developed over the area of the valve which is located within the diameter of seal 45. It will be appreciated that this diameter is considerably greater than the diameter of the head of the plunger 42, and therefore the hydraulic force developed over this area will be much greater, than the hydraulic force at the head of the plunger 42 itself.

In plunger pumps of conventional design, the fastening devices simply pass directly through the valve block 34 and are then fastened in the recesses 54, in power end 12. In this conventional design the total force actually applied to the valve block 34 will have to be withstood by the threaded recesses 54.

In most cases, the threaded recesses 54 are not designed or intended to withstand such extreme forces. Failure at this point, due to these excessive forces, is a relatively common problem.

However, in accordance with the features of the present invention described above, the provision of the abutments 62 enables the excessive forces developed between the cylinder 24 and the valve block 34 to become confined between the valve block 34 and the cylinder 26 by the abutments 62 and rod portions 56 of the fastening devices 50.

The portions of the fastening devices extending between the block 34 and flange 26, namely the rod portions 56, have a greater diameter than the threaded portions 52 entering the recesses 54. Consequently, they have the capacity to withstand these greater forces, and to confine them between the block 34 and the flanges 26.

Thus the threaded portions 52 seating in the recesses 54 are only required to resist the stresses created by the reciprocation of the pistons 18 and plunger 42 which is calculated by multiplying the hydraulic pressure by the area of the head of the plunger 42. The design criteria of the power end portion 12 is intended to accommodate such stresses and will thus function satisfactorily.

An additional fact arising from the use of the fastening devices 50, combined with the use of the individual separate cylinders 24, is that it greatly facilitates the alignment of the cylinders with their respective power end pistons. As explained above, slight degrees of misalignment were common in prior art, causing rapid wear of the plungers and packing within the cylinders 24.

By the use of the present invention, the assembly consists of first of all inserting and installing the eight studs or devices 50 in their respective recesses 54 in the power end cylinder block. The plungers 42 are installed on their connecting rods or so-called "pony" rods 44 which are, in turn, secured to their respective power end pistons 18.

The separate cylinders 24 can then simply be slid into position. By the provision of a degree of clearance in the notches 29 on the flanges 26, and a degree of clearance between adjacent flanges 26 of adjacent cylinders, the cylinders 24 can align themselves with their respective plungers, and substantially perfect alignment can be secured for each of the three cylinders and their plungers.

The valve housing is then lowered down over the rod portions 56 of the studs 50. By the provision of a suitable degree of clearance in the openings 63 in the valve housing 34, the tolerance in the location of the threaded recesses 54 in the power end cylinder block 12 can readily be accommodated by the valve housing block 34. The nuts can then be tightened down on the threaded portions 58 of the studs, and the valve housing block will then be securely clamped to the three separate clamping flanges 26 of the three separate cylinders 24.

Thus the invention both solves the problem of excessive stresses generated by the hydraulic forces, being transmitted to the cylinder block of the power end, and also, at the same time, solves the problem of misalignment between the power end, the cylinders, and the valve housing.

Figure 6:
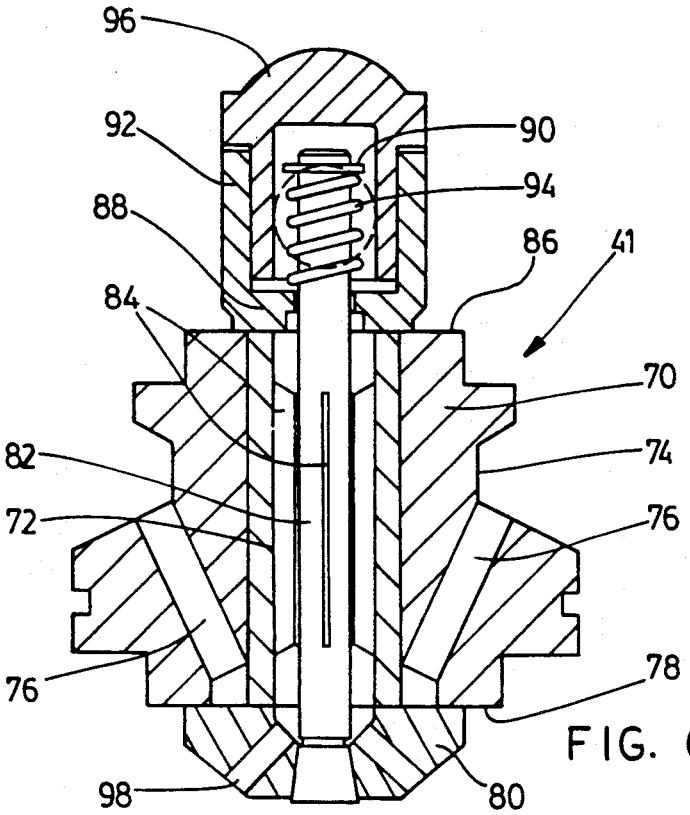
FIG. 6 is a sectional illustration along the line 6—6 of FIG. 2, illustrating the valve, and, FIG. 7 is a sectional illustration corresponding to the section of FIG. 2, showing an alternate embodiment.

Referring now to FIG. 6, the valve 41 is shown in more detail. It will be seen to comprise a body portion 70, defining an axial throughbore 72. An annular inlet channel 74 is formed in body 70 midway between its two ends. A plurality of angled inlet conduits 76 are formed in body 74 extending between channel 74, and the lower end 78 of body 70.

An inlet closure disk 80, is adapted to register with conduit 76 and close the same. Closure disk 80 is mounted on a valve stem 82 extending through bore 70. Valve stem 82 is of reduced diameter in relation to bore 72, so as to permit fluid flow therearound. Guides or spacers 84 may be provided on stem 82.

Stem 82 extends outwardly beyond the upper or outlet end 86 of body 70. Mounted on stem 82 is an outlet closure plate 88. A head portion 90 is secured on stem 82, and stem 82 passes through an opening in plate 88. Extending upwardly from plate 88 is a sleeve 92, and a spring 94 extends between head 90, and plate 88.

Sleeve 92 is retained in postion by threaded cap 96.

High pressure fluid outlet passageways 98 are formed in closure 80.

The function of the valve is best understood with reference to FIG. 2. Low pressure supply fluid is supplied through conduit 36, and flows around channel 74. The pressure of the supply fluid will typically be line pressure of 80 to 100 psi for example.

The pressure of the supply fluid will cause closure 80 to move away from body 70, and spring 94 is calculated so as to yield at the appropriate pressure. Supply fluid will thus fill the chamber 25, within the packing means 30 in cylinder 24.

Once a given cylinder is filled, i.e., when its plunger is at bottom dead centre, then no further supply fluid can enter, and spring 94 will then cause closure 80 to close on the lower end 78 of body 70. As the plunger then starts its upward pressure stroke, fluid will then be forced out of the chamber. Such fluid will pass through the passageways 98, up central bore 72, and cause the plate 88 to lift off the upper end 86 of body 70. Such high pressure fluid will then pass through conduit 38, and exit from the fluid end via conduit 40.

Valves of this design have substantial advantages over known designs of valves in that the unswept volume is reduced to a minimum, thereby greatly increasing the effiency.

However, depending upon the actual working pressures desired to be generated, other valves of know conventional designs may function for the purpose, and the invention is not to be taken as limited to the particular valve design as shown in FIG. 6.

Figure 7:
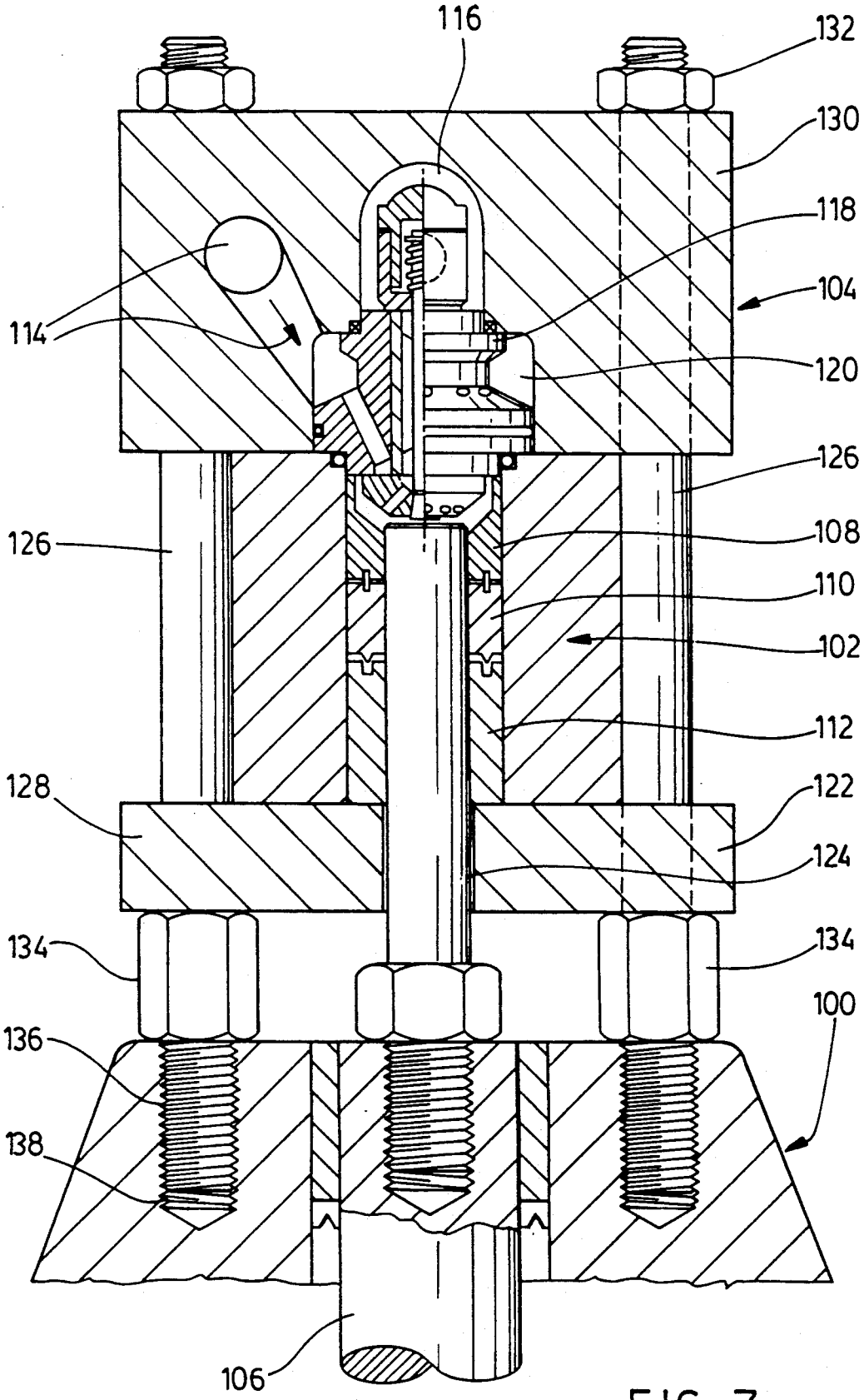

Referring now to FIG. 7, an alternate embodiment of the invention is there illustrated, embodying the same principles in relation to the studs but in a somewhat different configuration.

In the embodiment of FIG. 7, the cylinder block of the power end is represented generally as 100, the cylinders of the fluid end are indicated as 102, and the valve housing is indicated generally as 104. Within the power end 100, the crank shaft and pistons are omitted, and rod 106 represents the equivalent of rod 44 of FIG. 2.

Each of the fluid end cylinders 102 comprises a cylindrical sleeve member, defining an interior chamber 108, receiving the usual packing and seals 110.

A plunger 112 is secured to the upper end of rod 106, and is received within the packing 110.

The valve block 104 provides a supply passageway 114, and a return passageway 116, connected to supply and return hoses (not shown). Valves 118, similar to the valve 41 of FIG. 6, are shown located in valve chambers 120.

In order to secure the fluid end cylinders 102 to the valve block 104, a clamping plate 122 is provided, having a series of oversize passageways 124, for receiving respective plungers 112.

Clamping plate 122 is secured to the valve block 102 by means of studs 126 passing through suitable oversize openings (shown in phantom) as 128 in plate 122 and passing through suitable oversize openings shown in phantom as 130 in valve block 104.

The upper ends of the studs 126 are threaded to receive nuts or other suitable fastenings 132.

Abutments 134 are formed on studs 126, and are adapted to abut against the underside of plate 122. In this way, by tightening up the nuts 132, the plates 122 clamp the cylinders 102 against the valve housing. Hydraulic pressures "seen" by the valve housing 104 will thus be confined, between the nuts 132 and the abutements 134, and will not be communicated to the power end cylinder block 100.

The lower ends of the studs 126 as at 136 are threaded and received in suitable recesses 138 in cylinder block 100. Preferably, in this embodiment, the abutments 134 are formed as hexagonal shapes, so as to facilitate assembly and disassembly.

The operation of the fluid ends and valves is otherwise the same as that described in the embodiment of FIG. 2.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A fluid end assembly for use in a plunger pump apparatus of the type having a power end, and a plurality of plungers and means for reciprocating the plungers, and to which said fluid end assemblies are attached, said power end having a plurality of securement means for receiving fastening means, said fluid end assembly comprising:

a plurality of cylinder body means defining cylinders adapted to receive respective said plungers;

a valve housing adapted to be attached at one end of said cylinder body means and adapted to contain valve means;

clamping means for securing said cylinder body means to said valve housing, said clamping means defining a plurality of spaced-apart opening means;

a plurality of fastening devices, in turn, comprising rod means, first and second fastening means at respective ends of said rod means, a first one of said fastening means being adapted to be attached to said power end, and a second one of said fastening means being adapted to be secured to said valve housing, and, abutment means formed on said rod means intermediate said ends, said abutment means being located whereby to engage said clamping means, and thereby clamp said cylinder body means to said valve housing, whereby hydraulic stresses developed between said cylinder means and said valve housing are confined between said abutment means and said second one of said fastening means.

2. A fluid end assembly as claimed in claim 1 wherein said rod means defines a power end portion, of a predetermined first diameter, and a fluid end portion of a predetermined second diameter greater than said first diameter.

3. A fluid end assembly as claimed in claim 1 wherein said cylinder body means includes clamping flange means, adapted to be clamped to said valve housing, and including collar means defining an opening of reduced diameter in relation to the diameter of said cylinders, packing means within said cylinders, and, plunger means adapted to pass through said opening in said collar means, and through said packing means in said cylinders, said plungers being coupled to said power end, for reciprocation within said cylinders.

4. A fluid end assembly as claimed in claim 1 wherein said cylinder Body means are separate from one another, and are adapted to be attached to said power end spaced apart from one another, whereby to facilitate centering of said cylinder body means on respective said plungers.

5. A fluid end assembly as claimed in claim 3 wherein said clamping flange means define four corners, and there being notch means at each corner, for reception of said rod means therein.

6. A fluid end assembly as claimed in claim 1 including a plurality of rod openings in said valve housing, and wherein said rod means are of a predetermined diameter, and wherein said valve housing openings are of a predetermined second diameter greater than said diameter of said rod means, whereby to accommodate manufacturing tolerances present in said power end.

7. A fluid end assembly as claimed in claim 1 wherein said clamping means comprises a clamping plate adapted to engage said cylinder, a plurality of plunger openings in said clamping plate, through which said plungers may pass into said cylinders, a plurality of fastening openings in said clamping plate, said fastening openings being oversize relative to said rod means, whereby to permit accommodation of manufacturing tolerances present in said power end.

8. A fluid end assembly as claimed in claim 1 wherein said cylinders are oversize relative to the diameter of said plungers, and including packing means in said cylinders, and elastomeric spring means in said packing means, whereby to preload the same in compression, and prevent movement thereof within said cylinders due to friction with said plungers.

* * * * *